US006503040B1

(12) United States Patent
Abegglen et al.

(10) Patent No.: US 6,503,040 B1
(45) Date of Patent: Jan. 7, 2003

(54) APPLICATOR FOR APPLYING ADHESIVE TO THE SPINE OR ADJOINING REGIONS OF A BOOK BLOCK GUIDED PAST THE APPLICATOR

(75) Inventors: Peter Abegglen, Bissegg (CH); Peter Fischer, Winterthur (CH)

(73) Assignee: Grapha Holding AG (CH)

( * ) Notice: Subject to any disclaimer, the term of this patent is extended or adjusted under 35 U.S.C. 154(b) by 0 days.

(21) Appl. No.: 09/662,124

(22) Filed: Sep. 14, 2000

(30) Foreign Application Priority Data

Sep. 17, 1999 (EP) ..... 99810832

(51) Int. Cl.[7] ..... B05C 1/00

(52) U.S. Cl. ..... 412/37; 412/8; 118/256; 118/258; 118/261

(58) Field of Search ..... 412/37, 8; 118/261, 118/258, 256

(56) References Cited

U.S. PATENT DOCUMENTS

| | | | | | |
|---|---|---|---|---|---|
| 2,605,739 | A | | 8/1952 | Florez | |
| 3,788,270 | A | * | 1/1974 | Blair | 118/202 |
| 3,866,568 | A | * | 2/1975 | Minami | 118/238 |
| 3,898,955 | A | * | 8/1975 | Rosette et al. | 118/101 |
| 3,980,514 | A | * | 9/1976 | Rosette et al. | 412/37 |
| 4,335,674 | A | * | 6/1982 | Winker et al. | 118/110 |
| 4,373,985 | A | * | 2/1983 | Glendening | 118/100 |
| 4,512,945 | A | * | 4/1985 | Vigano | 118/410 |
| 4,677,005 | A | * | 6/1987 | Riesmeier et al. | 427/428 |
| 5,154,447 | A | * | 10/1992 | Tooker | 281/21.1 |
| 5,250,318 | A | * | 10/1993 | Tooker | 118/246 |
| 5,261,769 | A | * | 11/1993 | Leclerc | 412/20 |
| 5,271,794 | A | * | 12/1993 | Jarrell et al. | 156/538 |
| 5,605,575 | A | * | 2/1997 | Anderson | 118/101 |
| 5,693,142 | A | * | 12/1997 | Pedigrew et al. | 118/110 |
| 5,988,968 | A | * | 11/1999 | Hansmeier et al. | 412/11 |
| 6,338,603 | B1 | * | 1/2002 | Cerruti | 270/52.08 |
| 2002/0064437 | A1 | * | 5/2002 | Kuramoto et al. | 412/37 |
| 2002/0067977 | A1 | * | 6/2002 | Cobene, II et al. | 412/1 |

FOREIGN PATENT DOCUMENTS

| | | | |
|---|---|---|---|
| DE | 3438258 | | 5/1985 |
| EP | 0749849 | | 12/1996 |
| JP | 2001138663 | * | 5/2001 |

OTHER PUBLICATIONS (1) Dieter Liebau, *Industrielle Buchbinderei* (*Industrial Bookbinding*), Beruf + Schule, 1997, pp. 250–251.
(2) Alfred Furler, *Technologie der Klebebindung* (*Adhesive Binding Technology*), Deutscher Drucker Stuttgart, 1971, pp. 177–182.

* cited by examiner

*Primary Examiner*—A. L. Wellington
*Assistant Examiner*—Mark T. Henderson
(74) *Attorney, Agent, or Firm*—Venable; Robert Kinberg

(57) ABSTRACT

An applicator for applying an adhesive to a spine or adjoining regions of a book block conveyed guided past the applicator along a conveying plane in a conveying direction includes a trough for holding the adhesive. At least one applicator roller protrudes into the trough and is arranged for transferring adhesive onto the spine of the book block for forming an adhesive layer on the spine. The roller is driven in a direction which is the same as the conveying direction and defines an approach region in which the surface of the roller approaches the conveying plane. A sharply-pointed separating wedge is disposed downstream of the approach region of the applicator roller and forms a separating region for the supplied adhesive between the applicator roller and the conveying plane of the book block.

5 Claims, 1 Drawing Sheet

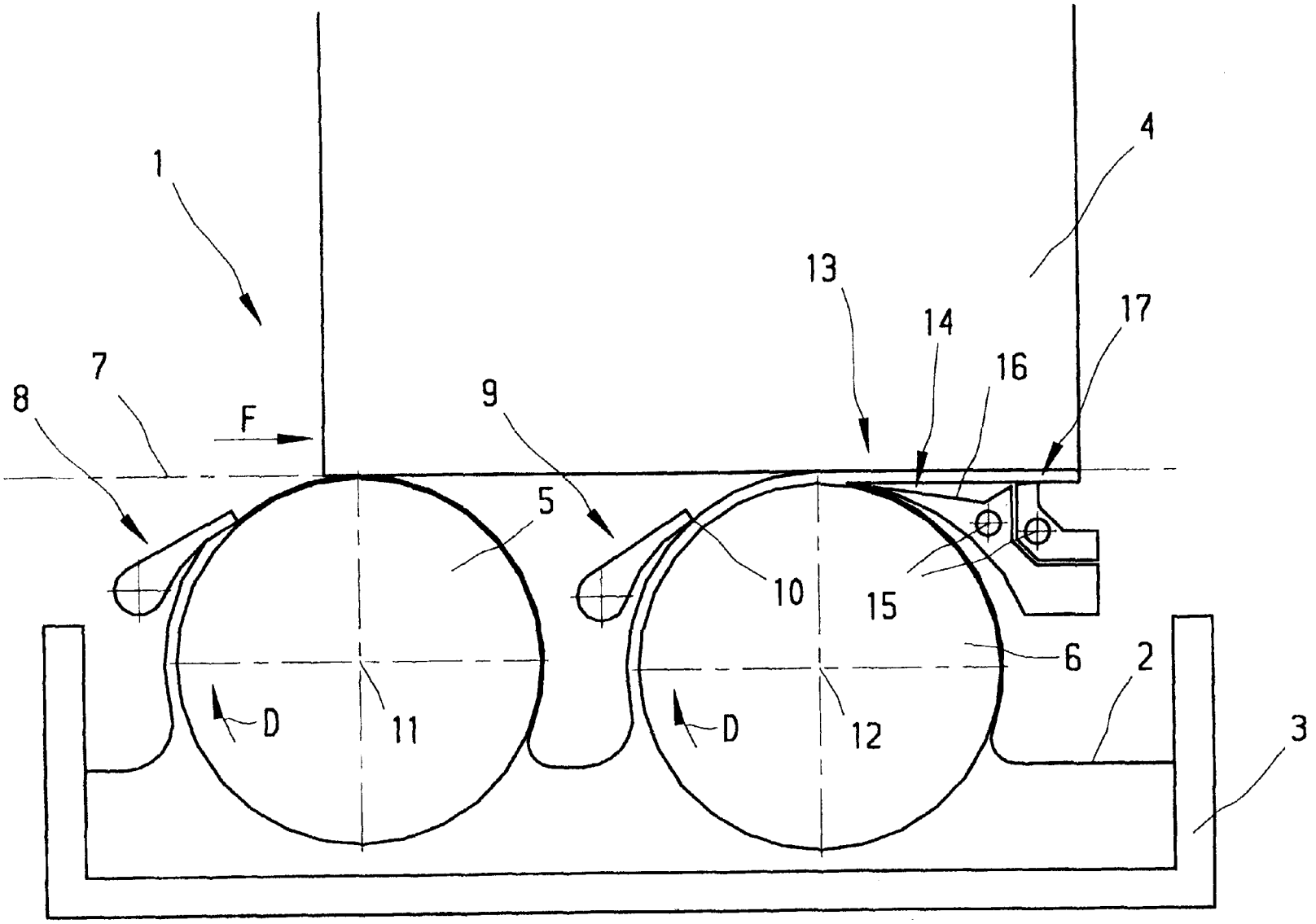
1
2
3
4
5
6
7
8
9
10
11
12
13
14
15
16
17
F
D
D

APPLICATOR FOR APPLYING ADHESIVE TO THE SPINE OR ADJOINING REGIONS OF A BOOK BLOCK GUIDED PAST THE APPLICATOR

CROSS-REFERENCE TO RELATED APPLICATIONS

Priority is claimed with respect to application No. 99810832.8 filed on Sep. 17, 1999, in the European Patent Office, the disclosure of which is incorporated herein by reference.

BACKGROUND OF THE INVENTION

The invention relates to a glue applicator for applying an adhesive to the back or bordering regions of an inner book guided past the applicator, comprising a trough that holds the adhesive, into which at least one applicator roller that transfers the adhesive onto the back of the inner book protrudes, the roller being driven in the same direction as the inner book and, after the approach region to the inner book, forming a break-off region for the adhesive with the approach region.

A glue applicator of the above-described type is schematically outlined in, for example, "Industrielle Buchbinderei [Industrial Bookbinding]" by Dieter Liebau, 1997, Beruf+Schule Itzehoe [publisher]. This glue applicator has two applicator rollers, which are disposed one behind the other and transfer the adhesive from a trough onto the back of an inner book twice.

The selected metering of the adhesive to be transferred is effected by a doctor blade disposed upstream of the application region. A spinner that rotates in the opposite direction of the conveying direction of the inner book, and often at a higher rotational speed than the applicator roller associated with it, levels the adhesive layer applied to the back of the inner book. The rotational speed of an applicator roller approximately corresponds to the transport speed of the inner books.

The adhesive taken up from the trough by an applicator roller is applied to a specific layer thickness by a doctor blade prior to the transfer to the back of the inner book, then applied to the back of a co-rotating inner book. In terms of a favorable penetration by the adhesive, the established distance between the back of the inner book and the surface of the applicator roller generates a specific penetration pressure on the adhesive to be transferred; this pressure is alleviated again after the closest approach, with an uneven layer of adhesive being left behind on the back of the inner book. The spinner levels the uneven area left on the back of the inner book by removing so-called glue threads from the adhesive.

The position of the adhesive break-off region depends on, among other things, the viscosity of the adhesive, the distance between the back of the inner book and the applicator roller, the thickness of the adhesive to be applied, the running speed and the roller diameter. In addition to being inadequate, the adhesive surface is thicker in the longitudinal center than at the edges due to the surface tension of the adhesive. Consequently, the desired application thickness for an optimum binding quality often cannot be achieved in the edge regions. The shearing stress of the adhesive, as created by the spinner, often leads to uncontrollable penetration at the side edges of the back of the inner book, or to diminished quality.

SUMMARY OF THE INVENTION

It is therefore an object of the invention to embody a glue applicator of the type mentioned at the outset such that simple means eliminate the aforementioned disadvantages.

The above and other objects are achieved according to the invention by the provision of an applicator for applying an adhesive to a spine or adjoining regions of a book block conveyed guided past the applicator along a conveying plane in a conveying direction, comprising: a trough for holding the adhesive; at least one applicator roller protruding into the trough and arranged for transferring adhesive onto the spine of the book block for forming an adhesive layer on the spine, the roller being driven in a direction which is the same as the conveying direction and defining an approach region in which the surface of the roller approaches the conveying plane; and a sharply-pointed separating wedge disposed downstream of the approach region of the applicator roller and forming a separating region for the supplied adhesive between the applicator roller and the conveying plane of the book block.

By so disposing the sharply-pointed separating wedge, a flowing, longitudinal separation of the supplied adhesive layer is possible after the adhesive has been transferred onto the spine of the book block.

The separating wedge is advantageously adjustable for changing its position, so it can be adapted to variable application conditions.

The wedge surface of the separating wedge that faces the conveying plane of the back of the inner book preferably forms an acute "hold-off" angle with the conveying plane, which opens in the conveying direction, thereby effecting a clean separation between the adhesive applied to the spine of the book block and the separating wedge.

For further treating the surface of the adhesive layer applied to the spine of the book block, a smoothing apparatus, which scrapes the surface of the adhesive, is provided downstream of the separating wedge. This smoothing apparatus advantageously has a level surface that faces the conveying plane of the book block and can be positioned to contact the applied adhesive at a substantially flat angle, so that the adhesive can be easily removed or leveled.

The apparatus of the invention is described below by way of an embodiment, with reference to the drawing, which includes all of the details that are not mentioned in the description.

BRIEF DESCRIPTION OF THE DRAWINGS

The single drawing FIGURE is a cross section through an adhesive-application station.

DETAILED DESCRIPTION OF THE INVENTION

Referring to the FIGURE, there is shown a glue applicator 1 essentially comprising a trough 3, which holds an adhesive or glue 2, and in which two smooth applicator rollers 5, 6 are disposed to dip into the adhesive 2. The rollers are driven to rotate relative to book blocks 4 that pass through a processing segment standing perpendicular to the conveying direction F in an adhesive binding machine. Glue applicator 1 has two applicator rollers 5, 6 to assure a more reliable adhesive transfer than would be possible with one applicator roller 6, because the two applicator rollers 5, 6 can be set at different distances from the book blocks 4 passing in a level conveying plane 7. In this case, the first applicator roller 5 is set to transfer a smaller quantity of adhesive. A doctor blade 8, 9, which has a scraping edge 10 that is oriented toward the applicator drum 5, 6, and determines the quantity of adhesive on the applicator roller 5, 6, sets the application quantity.

In the illustrated embodiment, doctor blades 8, 9 are embodied to pivot about an axis that extends parallel to the rotational axes 11, 12 of the applicator rollers 5, 6. The applicator rollers 5, 6 are dipped as far into the adhesive 2 as is shown by the indicated adhesive level, and convey the adhesive 2 upward in the indicated rotational direction D. The excess adhesive that has been scraped off by the doctor blade 8, 9 flows back into the trough 3, which can be provided with a heating element for preparing the adhesive 2. The second applicator roller 6 is provided for stabilizing the book spine, and conveys a thicker adhesive film than the first applicator roller 5, so it is spaced slightly further from the spine of the book block.

The excess adhesive 2 applied to the spine of the book block is no longer smoothed by a spinner or a scraping doctor blade—as disclosed in, among other publications, "Technologie der Klebebindung [Adhesive Binding Technology]" by Alfred Furler, "Deutscher Drucker" [publisher]—but by a sharply-pointed separating wedge 14 that is disposed downstream of the applicator roller 5, 6 and forms the separating region 13 for the supplied adhesive 2 between the roller and the conveying plane 7 of the book block spines. The separating wedge can be set to produce a fairly level adhesive surface on the spine of the book block in the separation region 13, where the conveying plane 7 and the applicator roller 5, 6 separate again. In terms of adaptability to physical conditions and those related to binding technology, the separating wedge 14 is adjustable, so it can be shifted deeper or less deep, closer or less close to the conveying plane 7. Its contact angle in the separation region 13 is also selectable; a pivoting axis can be provided, for example.

The cross-sectional shape of the separating wedge 14, which is preferably similar to a sword, has at its free end an edge that is nearly blade-sharp, and divides the adhesive film into two branches having smooth separation surfaces. It is significant that the separating wedge 14 is inserted into the separating region 13 such that its wedge surface 16 facing the conveying plane 7 of the spine of the book block forms an acute "hold-off" angle with the conveying plane 7, which is open in the conveying direction F, so no adhesive 2 can build up on the separating wedge 14.

Adjoining the separating wedge 14 is a smoothing apparatus 17, which smoothes the adhesive applied to the back of the inner book. This apparatus 17 can be secured to the separating wedge 14, or the wedge can be secured to the apparatus, with the respective supporting/secured element being connected to a machine base. The smoothing apparatus 17 has a level surface that can be positioned to contact the applied adhesive layer at a flat angle, with the spacing of the layer from the book back being altered by setting screws. The separating wedge 14 and the smoothing apparatus 17 each can be provided with a heating element 15.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An applicator for applying an adhesive to a spine or adjoining regions of a book block guided past the applicator along a conveying plane in a conveying direction, comprising:

a trough for holding the adhesive;

at least one applicator roller having a surface, the at least one applicator roller protruding into the trough and arranged for transferring adhesive onto the spine of the book block for forming an adhesive layer on the spine, the roller being driven in a direction which is the same as the conveying direction and defining an approach region in which the surface of the roller approaches the conveying plane; and a sharply-pointed separating wedge disposed downstream of the approach region of the applicator roller and forming a separating region for the supplied adhesive between the applicator roller and the conveying plane of the book block.

2. The applicator according to claim 1, wherein the separating wedge is adjustable.

3. The applicator according to claim 1, wherein the separating wedge has a wedge surface that faces the conveying plane of the book blocks and forms an acute angle with the conveying plane which is open in the conveying direction.

4. The applicator according to claim 1, further including a smoothing apparatus disposed downstream of the separating wedge and acting on the adhesive applied to the spine of the book block.

5. The applicator according to claim 4, wherein the smoothing apparatus has a level surface and contacts the adhesive layer at a substantially flat angle.

* * * * *